United States Patent [19]

Abler

[11] 4,006,609

[45] Feb. 8, 1977

[54] MANUFACTURING OF PATTERNED DEEP PILE CIRCULAR KNITTED FABRIC

[75] Inventor: Norman C. Abler, Menominee Falls, Wis.

[73] Assignee: Bunker Ramo Corporation, Oak Brook, Ill.

[22] Filed: Apr. 29, 1974

[21] Appl. No.: 465,269

[52] U.S. Cl. ..... 66/9 B; 19/105; 19/108; 19/240

[51] Int. Cl.[2] ..... D04B 9/14

[58] Field of Search ..... 19/105, 108, 109, 238, 19/239, 240, 241, 145.7; 66/9 B; 17/107, 89, 205

[56] References Cited

UNITED STATES PATENTS

| | | | |
|---|---|---|---|
| 739,246 | 9/1903 | Winn | 19/89 |
| 1,311,293 | 7/1919 | Schaefer | 19/109 |
| 1,323,297 | 12/1919 | McHale | 19/239 |
| 2,601,381 | 6/1952 | Freeman et al. | 19/89 |
| 2,711,562 | 6/1955 | Duesberg | 19/108 X |
| 2,725,599 | 12/1955 | Schorsch et al. | 19/241 |
| 2,971,357 | 2/1961 | Hill | 66/9 B |
| 2,993,351 | 7/1961 | Wheelock | 66/9 B |
| 3,099,048 | 7/1963 | Locher | 19/240 |
| 3,501,812 | 3/1970 | Schmidt | 66/9 B X |
| 3,728,872 | 4/1973 | Thore | 66/9 B |

FOREIGN PATENTS OR APPLICATIONS

| | | | |
|---|---|---|---|
| 710,949 | 7/1966 | Italy | 66/9 B |
| 418,260 | 10/1934 | United Kingdom | 19/108 |
| 736,154 | 9/1955 | United Kingdom | 19/109 |
| 187,567 | 2/1967 | U.S.S.R. | 19/108 |

*Primary Examiner*—Dorsey Newton
*Attorney, Agent, or Firm*—Hill, Gross, Simpson, Van Santen, Steadman, Chiara & Simpson

[57] ABSTRACT

In a deep pile fabric knitting machine which includes carding wheels from which fibers are transferred to rotary doffers and from which the fibers are selectively taken by knitting needles traveling with a rotary cylinder, but with at least some untaken fibers remaining on the doffers, remaining fibers are scavenged from the doffers, substantially uniformly dispersed and returned for recycling in the same carding paths from which the fibers were originally transferred to the doffers. Returned fibers may be applied directly to the perimeters of the carding wheels, or to sliver leading to the carding wheels. Scavenging may be effected by high speed scavenger rolls and return of the fibers effected pneumatically with mechanical dispersion. Loose fibers are blown from the knitting needles and recycled in the same system with the fibers scavenged from the doffers.

Sharp separation and definition between pattern features such as stripes is maintained even where fibers of different characteristics are selectively alternately supplied to and by a common fiber feed path.

Monitoring of the density of fibers in the fiber delivery for fiber feed paths is provided for.

17 Claims, 11 Drawing Figures

MANUFACTURING OF PATTERNED DEEP PILE CIRCULAR KNITTED FABRIC

This invention relates to the manufacture of deep pile circular knitted fabric and is more particularly concerned with solving the problem of attaining uniform pile density in such fabric in especially a circular deep pile knitting machine which has a number of carding heads located around the periphery of the needle cylinder to supply, respectively, fibers of different characteristics, i.e. type, color, length, etc., form each of the heads to the needles. Generally each characteristic fiber will be repeated a number of times equal to the number of sliver i.e. fiber feed paths divided by the number of colors and/or types and/or length of fibers used. Each of the heads is located in a stationary position so that as the needle cylinder revolves the needles more vertically into fiber taking position with respect to the respective doffer rolls of the heads to which intermediate rolls supply fiber taken from card wheels to which the fiber is supplied in the form of sliver.

According to prior practice, including the manufacture of patterned deep pile fabrics on circular knitting machines, the pattern features have necessarily been limited as to size and complexity in order to minimize pile density variations throughout the fabric. With machines in which needle selection has been purely mechanical, the problem has not been of urgent concern because, for the most part, mechanical needle selection means itself is restrictive. However, important advances have been made in the needle selection mechanism of deep pile knitting machines enabling a wider range of pattern size and complexity. The Brandt et al U.S. Pat. No. 3,709,002 represents an important advance in this direction, and according to which programmed sliver feed combined with electronic needle selection is provided. According to this Brandt et al patent, needle selection is effected under the control of one or more indicia bearing tapes of whatever length may be required to produce the desired pattern. With this system, the indicia on the tape determine which, if any, fiber is picked up by each needle on any given pass of that needle by a fiber feed station. The fiber supplies to the various feed lines or paths are similarly controlled by the tape system. Clutches or the like, actuated from the tape, control the fiber input quantities to correlate them with the needle selections and therefore the fiber utilization quantities. However, only a fraction of the potential for virtually unrestricted pattern design with machines so equipped has been exploited because of limited resolution of the effect of programmed sliver feed with respect to small pattern features in the operation of the machines. This problem arises because in programming patterns, generally only fibers corresponding to selected needles are taken from any given doffer. During intervals in which needles are not selected in respect to any particular doffer, no fibers are removed from corresponding portions of that doffer. Accordingly, the untaken fiber remaining on the doffer is layered with additional fiber transferred to the doffer from the intermediate roll, causing more densely populated regions to occur on the doffer. When the intervals of unselected needles with respect to any particular doffer become extreme, the density variations also become extreme, causing excessive fiber density variations in the pile of the fabric when selected needles eventually take fiber from the overdensely populated doffer.

An inadequate prior attempt to meet this problem is described in Hill U.S. Pat. No. 2,953,002. The Hill patent teaches a method whereby the fiber is returned to the system in a localized region at the bight formed by two cylinders. The point at which Hill returns the fiber to the system is by nature of his design close to the point of transfer of fiber back to the doffer and generally in alignment with the areas of the doffer from which the fibers were stripped. As a result, patches of fiber stripped from the doffer are quickly returned to the doffer as patches of fiber. No means are provided for dispersing the fibers. The density pattern is only distorted rather than removed.

With the Hill apparatus, if in a long interval needles selectively do not take fiber, or when proportionately few needles take fiber, an excessive amount of fiber accumulates on rolls within the recycle loop causing loading of card wire or clothing, needle breakage, density variations and other problems.

In the Hill machine, the fibers are excessively worked or brushed, resulting in a high incidence of broken fibers.

In contrast, according to the present invention the fibers are subjected to minimum working during recycling and they are dispersed over very large areas of the carding system, resulting in substantially uniform distribution of fiber population densities on the doffer. In addition, the doffer makes a large number of revolutions, such as up to 100 revolutions, while a given amount of dispersed fiber is recycled. In the Hill method, less than one revolution occurs while recycling the same amount of fibers and the fibers are subjected to much working in the numerous transfers from roll to roll.

Another problem that has heretofore existed is the wasting of loose fibers customarily blown from the needles by air jets just after the needles have taken a load of fibers from a doffer. Where fibers of different character, i.e., color, type, length, etc., are provided by respective doffers for manufacturing patterned deep pile fabric, it has heretofore been the practice to exhaust the blown off fibers as waste. Prior suggestions for recycling blown fibers, as in Wheelock U.S. Pat. No. 2,993,351 and Thore U.S. Pat. No. 3,728,872, ignore the need for integrity of fiber characteristics for each individual carding head when knitting patterned deep pile fabrics.

According to Brandt U.S. Pat. No. 3,122,904 fibers of different color characteristics may be supplied selectively in the same fiber feed paths for changing colors in knitting striped deep pile fabrics. However, a problem of maintaining separation or definition at the interface between the stripes has been encountered, either requiring wasteful cleaning of the fiber feed paths or compromising to the extent of permitting some intermixing of colors at the interfaces.

It is therefore an important object of the present invention to overcome the foregoing and other disadvantages, deficiencies, inefficiencies, shortcomings and problems in respect to attaining uniform density in the manufacture of patterned deep pile circular knitted fabric, and to attain important improvements and advantages and new and improved results with apparatus and according to methods as will hereinafter become apparent.

Another object of the invention is to provide new and improved means for and method of eliminating the density control problem in the manufacture of patterned deep pile circular knitted fabrics.

A further object of the invention is to provide an improved method of and means for attaining uniform density and also fiber integrity in patterned deep pile circular knitted fabrics, simply, efficiently and economically.

Still another object of the invention is to provide a new and improved method of and means for removing untaken fiber from the doffers in the manufacture of patterned deep pile circular knitted fabric and recycling the removed fibers in a manner to attain uniform fiber density at the doffers.

Yet another object of the invention is to recover and recycle for use the loose fibers customarily blown from the needles just after they have taken fiber from the doffers in the manufacture of patterned deep pile circular knitted fabric.

A still further object of this invention is to eliminate buildup of tramp fiber that causes defects in the form of impurities or slubs.

A yet further object of this invention is to eliminate migration of fiber from one fiber supply to another in a multiple carding head system.

It is another object of this invention to provide a more compact fiber feed path arrangement to enable placement of more fiber feed heads in a circular knitting machine.

It is a further object of this invention to provide means for recycling unused fibers, and to compensate the sliver feed rate proportionately by means which will modulate sliver feed for substantially uniform fiber supply to the doffer.

It is also an object of this invention to quickly purge a carding head of one color or characteristic fiber, such as when changing colors to knit stripes, so as to obtain sharp separation and definition at the interface between pattern features, such as stripes of different character.

Other objects, features and advantages of the invention will be readily apparent from the following description of certain preferred embodiments thereof, taken in conjunction with the accompanying drawings although variations and modifications may be effected without departing from the spirit and scope of the novel concepts embodied in the disclosure, and in which.

Figure 1:
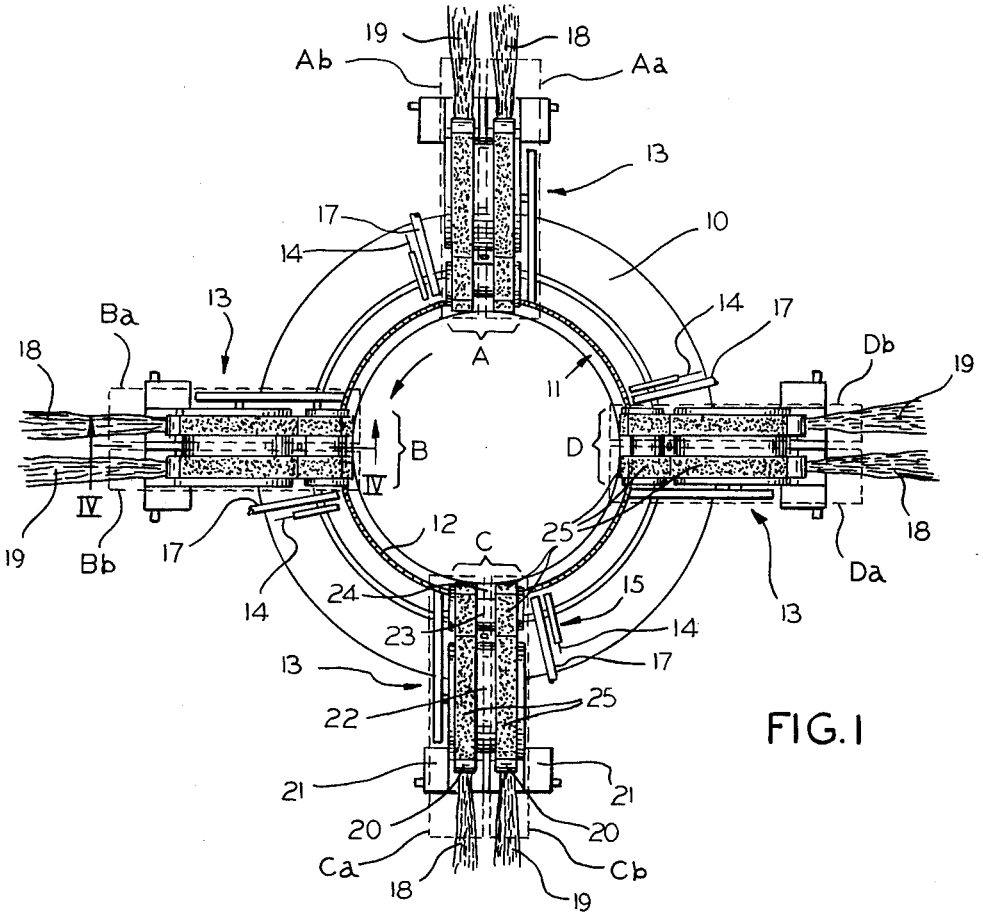
FIG. 1 is a somewhat diagrammatic plan view illustrating a circular deep pile knitting machine with which the present invention may be used.
Figure 2:
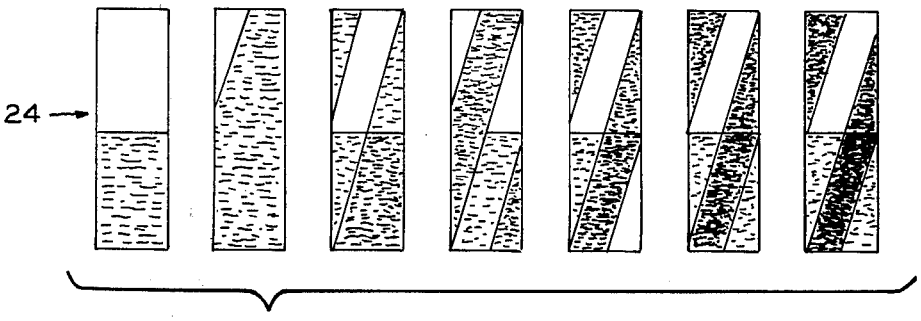
FIG. 2 is a diagrammatic illustration showing how a doffer may accumulate fiber of variable density population on its periphery in the course of operation.
Figure 3:
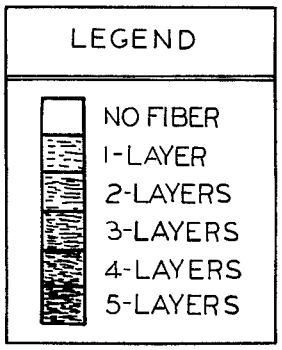
Figure 4:
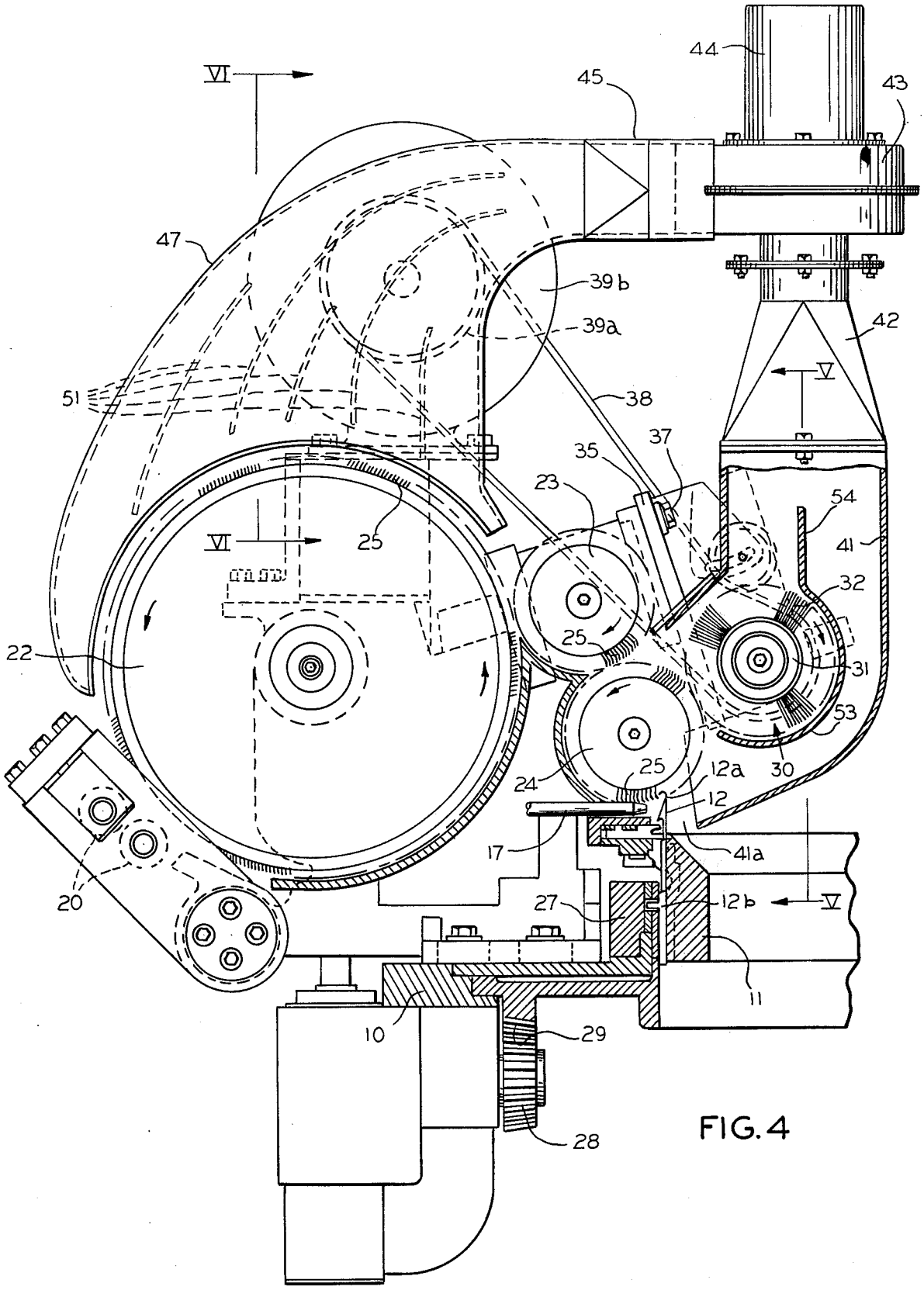
Figure 6:
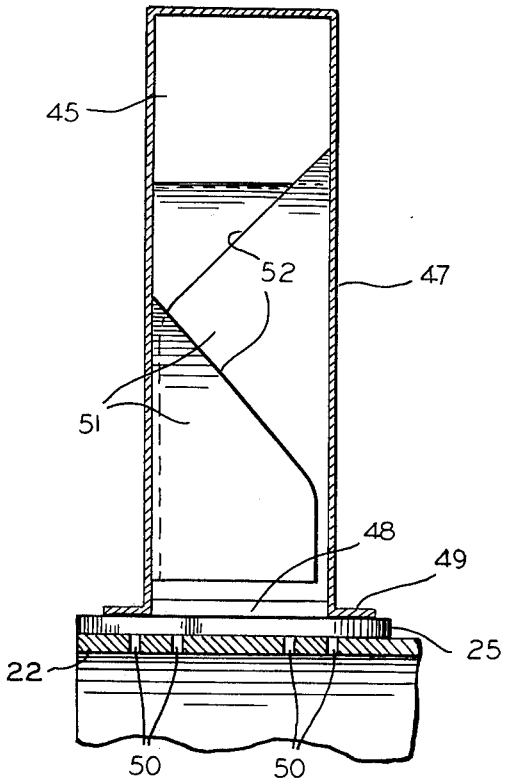
Figure 5:
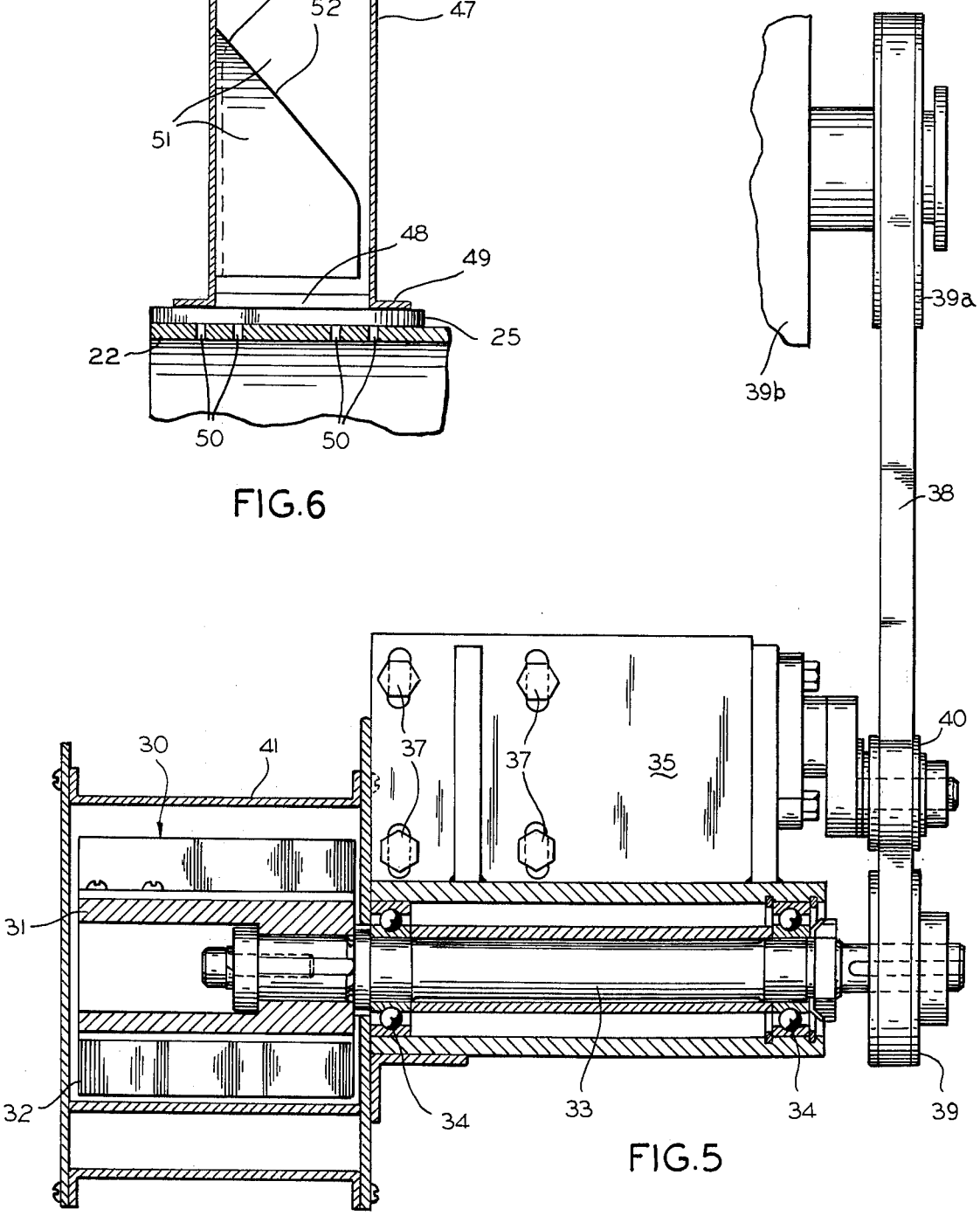
Figure 9:
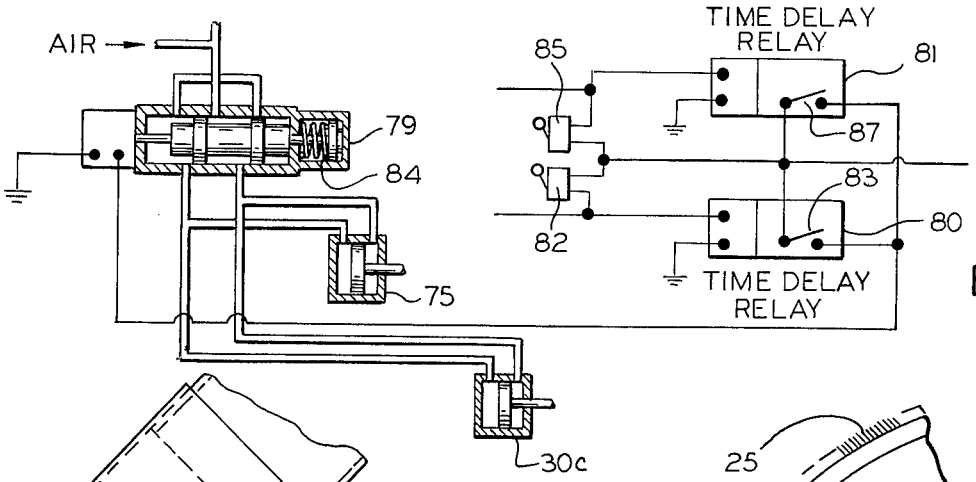
Figure 7:
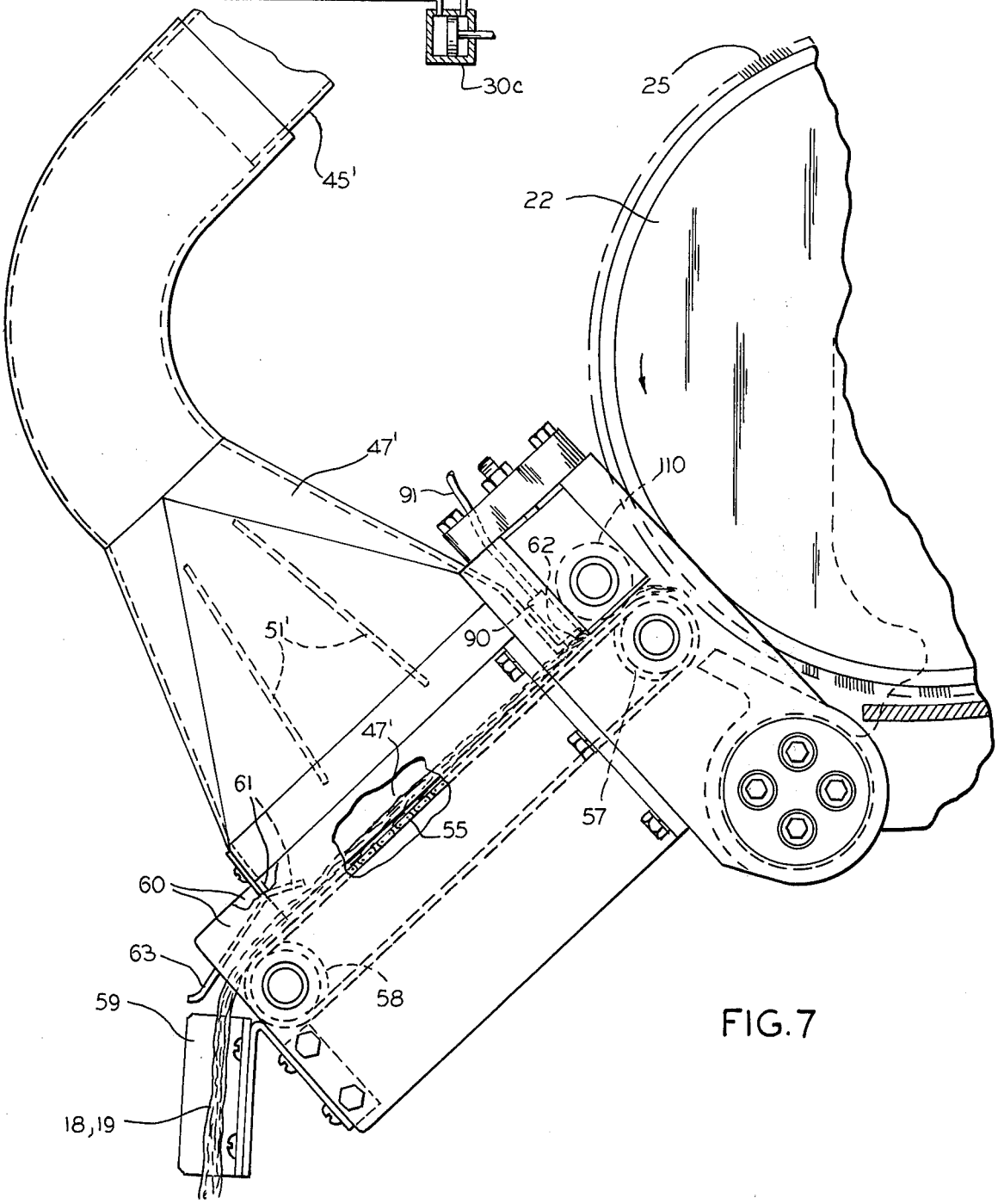
Figure 8:
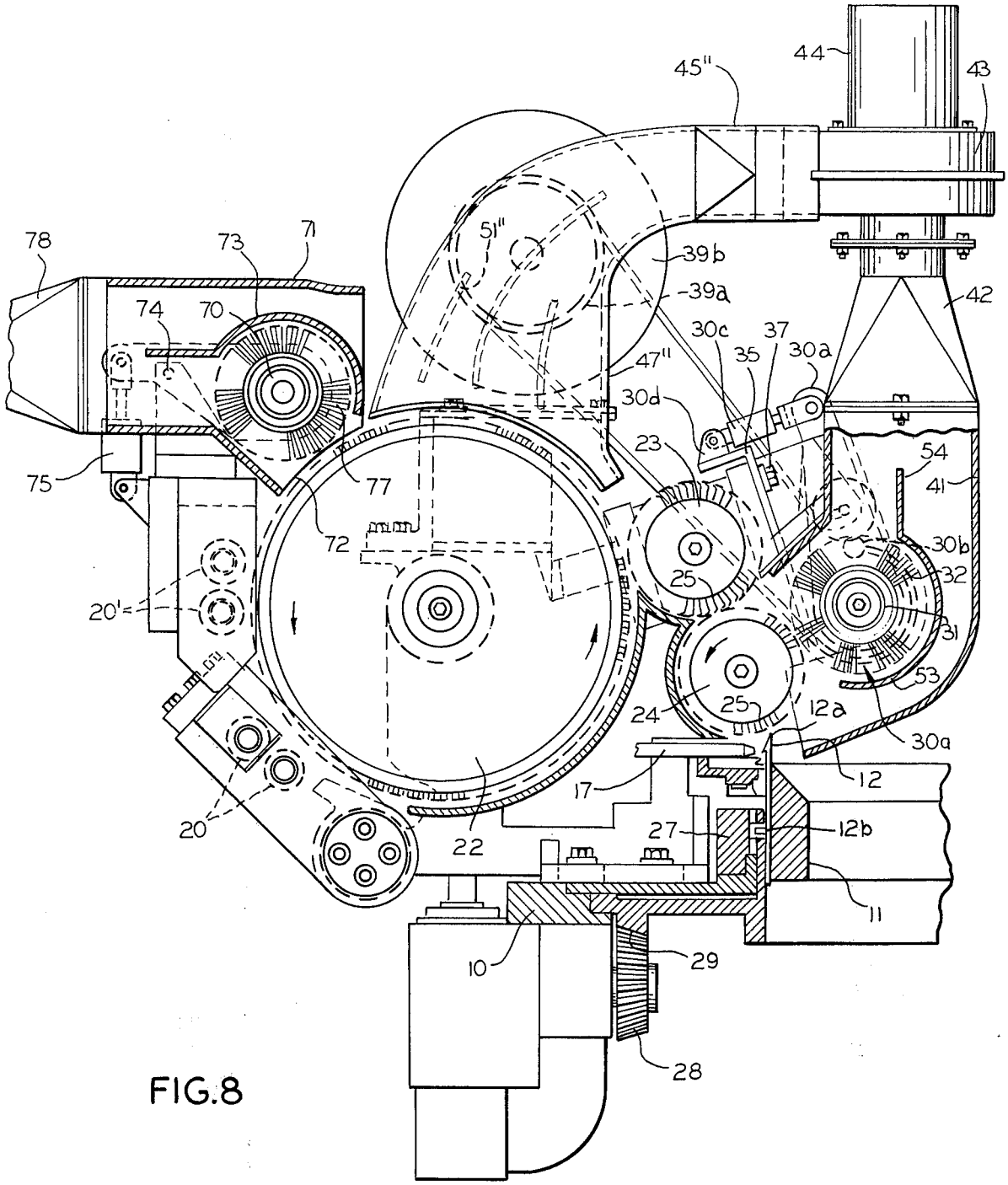
Figure 10:
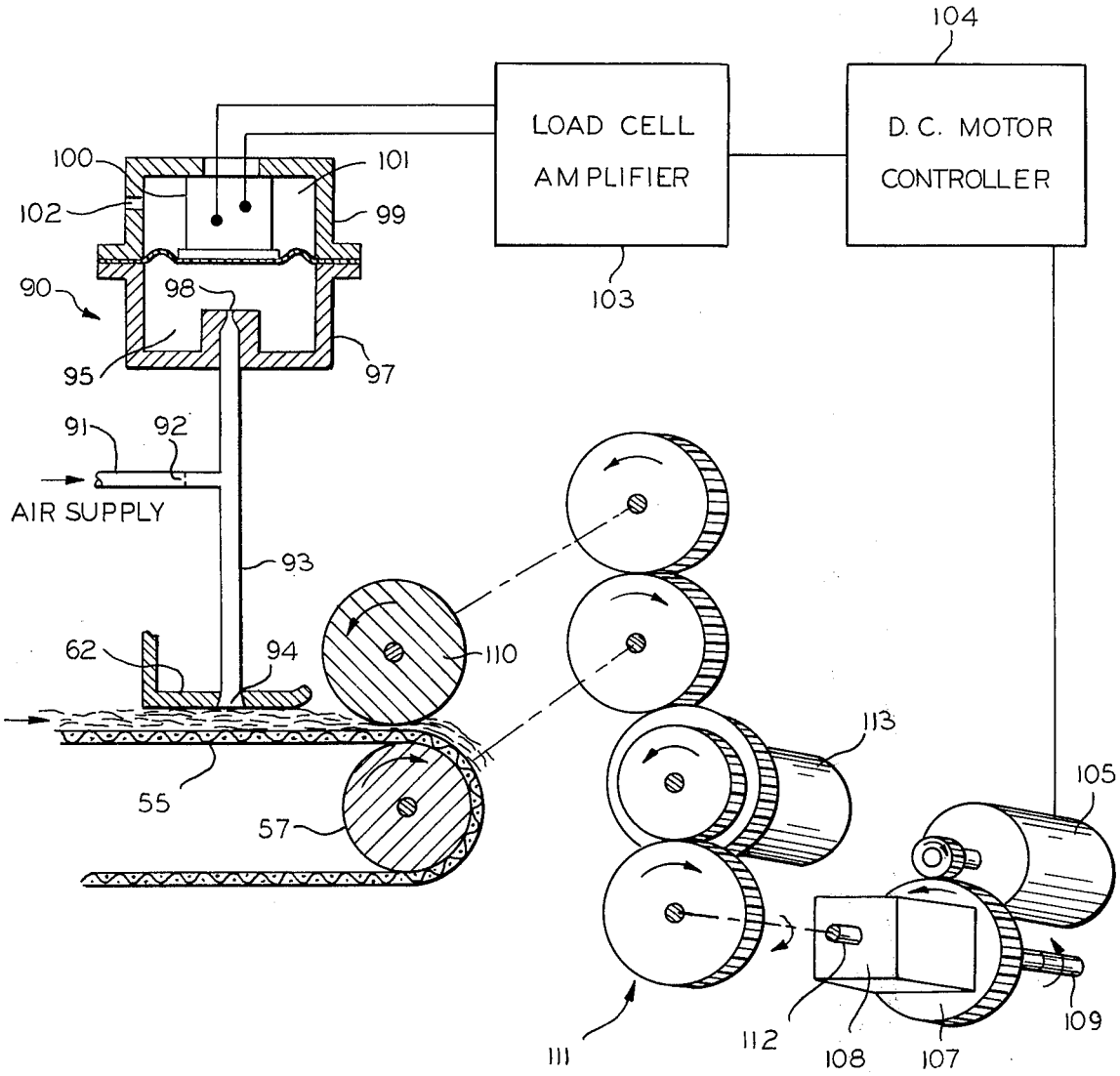
Figure 11:
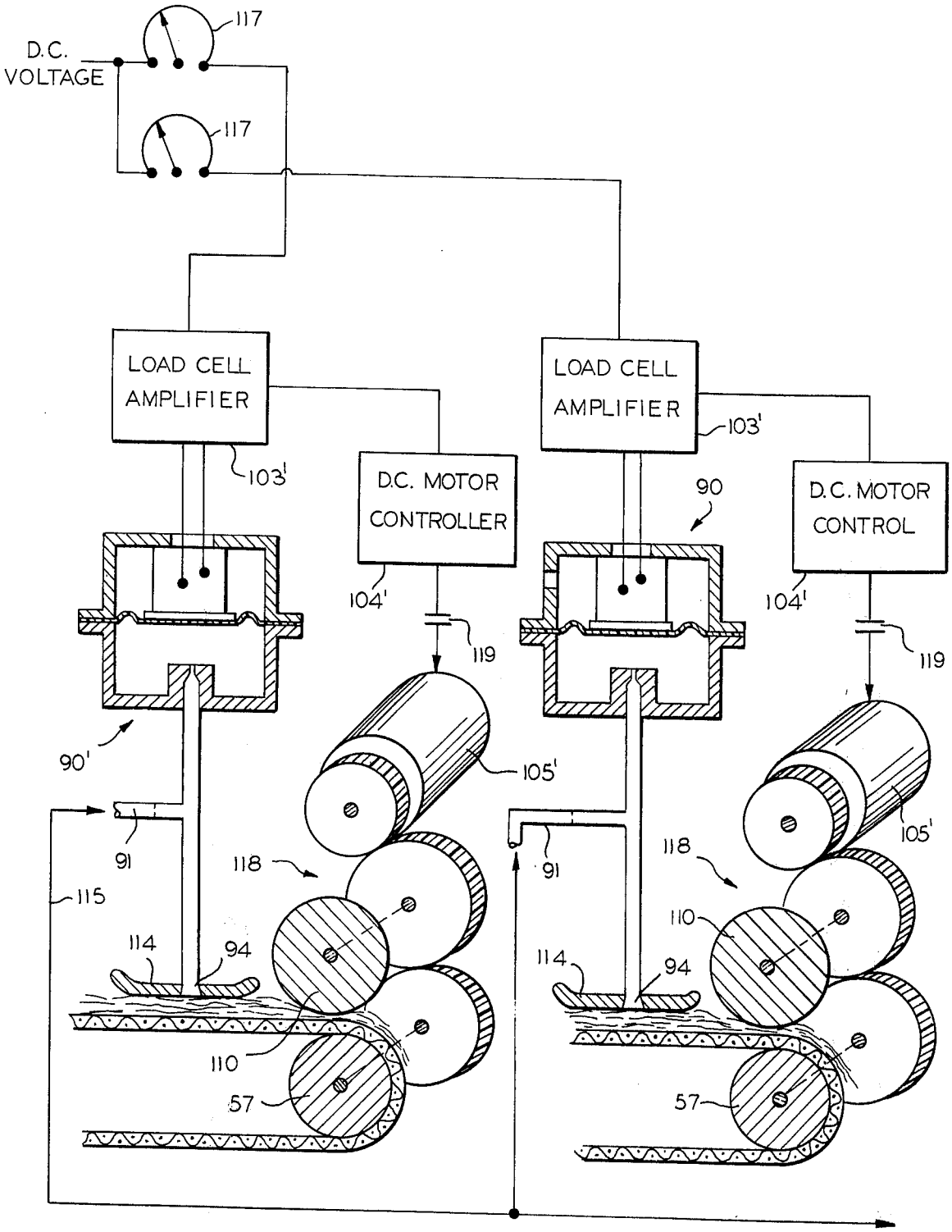

FIG. 3 provides identifying legends for interpreting the density patterns in FIG. 2;

FIG. 4 is a vertical sectional elevational view showing one carding head and apparatus according to the present invention applied thereto and may be considered as taken substantially along the line IV—IV of FIG. 1;

FIG. 5 is a fragmentary sectional detail view taken substantially along the line V—V of FIG. 4;

FIG. 6 is a fragmentary sectional detail view taken substantially along the line VI—VI of FIG. 4;

FIG. 7 is a fragmentary sectional elevational view taken in substantially the same plane as FIG. 4 but showing a modification in the recycling return of scavenged fibers;

FIG. 8 is a view similar to FIG. 4 but showing a modification enabling selective alternate use of the same carding paths for supplying fibers of different characteristics;

FIG. 9 is a control diagram related to the apparatus of FIG. 8;

FIG. 10 is a schematic view of means for monitoring and controlling sliver feed density; and FIG. 11 is a schematic illustration of a modification arrangement for monitoring and controlling sliver feed density.

In FIGS. 1 and 4, the general organization of a deep pile fabric circular knitting machine with which the present invention may be used is depicted. Such a machine may be on the order of that discussed in Beucus et al, U.S. Pat. No. 3,413,823 and includes stationary frame means 10 supporting a rotating needle cylinder 11 carrying vertically reciprocable knitting needles 12 in slots or grooves on its periphery. As the needle cylinder 11 rotates, as indicated by directional arrow, it brings the needles 12 successively past fiber feed stations A, B, C and D. Selected ones of the knitting needles 12 are moved upwardly in programmed sequence to receive or take in their hook portions pile fibers from respective feeding units 13 at the stations and a body yarn 14 from supply means indicated at 15. Then each such needle 12 is moved downwardly to draw a loop of the body yarn 14 through a previously formed body yarn loop, cast off such previously formed body yarn loop, and cause the pile fibers to become interlocked with the body yarn loops. Air jets 17 (FIGS. 1 and 4) are directed toward the needles 12 in the customary manner to orient the pile fibers so that they will protrude from the body yarn loops radially inwardly toward the interior of the knitted tube, and to blow away loose fibers. The number of stations A, B, etc., should be as great as is permitted by space limitations, and the like, because the rate of fabric production is a function of the number of feeds and economy is important in the manufacture of deep pile knitted fabrics. Four feed stations have been illustrated in FIG. 1 as exemplary of suitable high production equipment, providing for four courses of body yarn stitches to be formed during each revolution of the cylinder 11. A greater or lesser number of feed stations will produce a corresponding number of courses of knitted stitches during each revolution of the cylinder.

In the illustrated example, each of the pile fiber carding and feeding units 13 is of the dual fiber feed type such that at least two fiber inputs or supplies, e.g. rovings, loose fibers or slivers, 18 and 19 that may differ from one another in type, length, color and/or in some other characteristic may be simultaneously fed. For this purpose, each of the units 13 comprises a pair of fiber feed zones or paths delineated for illustrative purposes by respective dashed outline rectangles on FIG. 1, i.e. Aa and Ab for station A, Ba and Bb for station B, Ca and Cb for station C and Da and Db for station D. In each fiber feed path there is a pair of sliver feed rollers 20 controlled by mechanism 21 which may comprise a clutch unit in each instance. From the feed rollers 20 the sliver is delivered to a carding roll 22 from which the fiber is taken by transfer roll 23 which transfers the fibers to a doffer roll 24. In order to keep the fibers from the two slivers 18 and 19 separated throughout the roll system, there is a centrally located feed path separating gap in card clothing 25 on the peripheries of the rolls 22, 23 and 24. This assures thorough axial separation of the spaced apart fiber paths or lines from the feed rollers 20 to and including the doffer 24 of each of the units 13. Thus, for example, where the fibers of the sliver 18 are white and the fibers of the sliver 19 are red, or any other difference in color or other characteristic, the separated feed rollers 20 will feed the fibers from the respective slivers in spaced paths which will be maintained throughout travel in the unit 13 by reason of the gaps in the card clothing 25. Hence, the card clothing 25 of one end portion of the doffer 24 will be supplied with chosen characteristic fibers from the sliver 18 and the other end portion of the doffer 24 will be supplied with chosen characteristic fibers from the sliver 19.

Any preferred manner of programming the knitting needles 12 to produce patterned fabric may be employed to cause the needles to cooperate selectively with the doffers 24 of the various fiber carding and feeding units 13 to transfer fibers from the fiber feeding zones provided thereby to the knitted fabric. It will suffice herein to refer to the aforesaid Brandt et al U.S. Pat. No. 3,709,002 which to the extent necessary is incorporated herein by reference. According to that patent, not only are controllable means provided for regulating the quantities of pile fibers delivered to the respective spaced apart zones, but pattern means are provided for controlling the needle selector means as well as the controllable means for regulating the delivered quantities of pile fibers in correlated relation.

For the present purposes, it is deemed sufficient to refer to FIG. 4 as exemplifying each path of the dual fiber feed paths of each of the units 13 in relation to the needle cylinder 11. All of the rolls are suitably rotatably mounted on the frame 10 and driven in unison by suitable means, not shown, to feed fiber to the knitting needles 12. The carding roll 22 is of much greater diameter than the intermediate roll 23 which may be of about the same diameter as the doffer 24. The roll relationship is such that the clothing 25 of the carding roll 22 is contacted in fiber transferring relation by the clothing 25 of the intermediate roll 23 at the opposite side of the roll 22 from delivery to the roll 22 of the sliver. In this orientation rotation of the carding roll 22 may in a counterclockwise direction and rotation of the intermediate roll 23 in a clockwise direction at about twice the peripheral speed of that of the carding roll. Location of the doffer 24 is under the intermediate roll 23 with the clothing of these two rolls in fiber transferring relation and with the doffer 24 rotating counterclockwise as viewed in FIG. 4 at about twice the speed of the intermediate roll. Location of the doffer 24 relative to the knitting needle cylinder 11 is over the needles and with the doffer clothing 25 advancing toward hook portions 12*a* of the needles which can thus be selectively moved into position to take a load of fibers from the doffer clothing. As the needle cylinder 11 rotates on a vertical axis under the doffer 24 rotating on a horizontal axis the needle selector means carried by the frame 10 and represented by selector device 27 acting on butt portions 12*b* of the needles controls which of the needles will be moved into fiber-taking relation with respect to any given doffer path of the machine. Rotary support for the cylinder 11 is provided by the frame 10 and suitably driven pinion means 28 mesh drivingly with an annular rack 29 on the underside of the cylinder assembly.

Inasmuch as the needles 12 travel with the cylinder 11 past the doffer 24 in a rotary path which is across the width or a portion of the width of the doffer clothing 25, and the doffer is itself traveling rotatably, it will be clear that the fiber taking path of each needle head 12*a* along the doffer clothing 25 will be generally helical. Further, it must be remembered that in producing any preferred pattern in the pile of the knitted fabric, a plurality of the fairly closely spaced needles 12 will usually be simultaneously actuated to take fiber from the doffer. Since in patterned pile fabric knitting, only certain of the needles are directed to take fiber from any one of the fiber feed paths, fibers are generally taken from the doffer 24 in only a limited area and there are intervals in which no needles are selected and therefore no fiber is removed from the doffer. Yet the intermediate roll 23 will continue to transfer fiber to the doffer continuously, thereby causing fiber to be transferred not only to any area or areas from which fiber has been taken by the selected needles, but also to those areas from which no fibers have been taken by the needles. As a result there is an accumulation of fibers on the untaken areas causing a variation in the density of fibers, which can become extreme and lead to excessive fiber density variations in the pile of the knitted fabric where successive pattern necessitated taking of fiber from the doffer 24 reaches into the densely populated regions. To exemplify the problem, reference may be had to FIGS. 2 and 3. FIG. 2 shows in a typical step-by-step sequence how uneven accumulation of untaken fiber can accumulate in up to four revolutions of the doffer 24. FIG. 3 identified by legends the fiber density coding in FIG. 2. Thus, in FIG. 2 it will be observed that a uniform one layer of fiber has been transferred to the doffer by the intermediate roll at the start of operation. Then as fiber is taken from the doffer selectively, as represented by the diagonal no fiber areas on the successive doffer representations reading from left to right, it will be observed that there is a gradual buildup at untaken areas of up to five layers of fiber in four revolutions. This representation of the density pattern developed by the selective taking of fiber from the doffer 24 does not take into account any hunting ratio between the doffer and the cylinder and any tendency for the helical pattern to migrate to either side of the doffer or the rate of such migration across the doffer or the somewhat tempering effect of the intermediate roll causing smearing of the helical pattern, all of which do combine to temper the severity of the fiber buildup exhibited. Nevertheless, it will be appreciated that a fairly aggravating problem has existed and to the alleviation of which the present invention is directed.

According to the present invention, fibers not taken from the clothing 25 of the doffer 24 and remaining on the clothing after passing the operating range of the needles 12 are scavenged from the doffer before the doffer clothing contacts the clothing 25 of the intermediate roll 23 to receive a fresh one layer transfer of fibers to be carried by the doffer clothing to the operating range of the needles 12. In addition, the scavenged fibers are substantially uniformly dispersed and returned to the same carding wheel from which the fibers were originally transferred by way of the intermediate roll 23 to the doffer. By way of example, referring to FIGS. 4 and 5, a scavenger roll 30 is provided to remove from the doffer 24 fibers not taken by the needles 12. In a practical arrangement, the roll 30 is of the same length as the doffer 24 and has a mandrel core 31 carrying preferably straight radial bristles 32 which are desirably of bristle wire similar to that of the clothing 25 and of about the same numerical density but somewhat longer and without the customary angular terminals of the clothing bristles.

Means are provided for mounting the scavenger roll 30 on an axis parallel to the axis of the doffer 24 and with the scavenger bristles 32 reaching toward the doffer clothing bristles 25 at a convenient location along the periphery of the doffer 24 beyond the operating range of the knitting needles 12 and before the area of contact between the intermediate roll 23 and the doffer 24, which may be about diametrically opposite the needles. The scavenger roll is located preferably about midway between those two areas of the doffer perimeter so that the perimeter of the roll 30 meets the doffer at about 90° removed from the needles 12 and the intermediate roll 23. Rotary support for the scavenger roll 30 is provided by an axial shaft 33 (FIG. 5) extending from one end of the core 31 and mounted in axially spaced high speed bearings 34 carried by a mounting bracket 35 secured as by means of screws 37 to the machine frame 10. Flexible driving means such as a V-belt 38 engages over a pulley 39 on the free end portion of the shaft 33 and over a drive pulley **39*a* which is adapted to be driven by suitable power source such as a high speed electrical motor 396. A suitable tensioning pulley 40 may be provided to maintain the drive belt 38 under proper operating tension. In a practical arrangement, the scavenger roll 30 is driven to rotate in the opposite direction from the doffer so that the roll 30 will travel continuously in the same peripheral direction as the doffer 24 at the location where the fibers are being scavenged and at a sufficiently greater speed differential, i.e. greater peripheral velocity than the doffer, to assure thorough cleaning removal of fibers which remain on the bristle wires of the doffer clothing 25. In one practical arrangement where the doffer rotates at about 1,300 RPM, the scavenger roll 30 may rotate at from 2,500 to 5,000 RPM. This assures not only efficient cleaning of the doffer clothing but also efficient discharge of the removed fibers from the scavenger bristle 32, due at least in part to the combined effects of centrifugal force and the air stream created by the bristles of the high speed scavenger roll 10**.

It should be noted that in most uses the air currents around the scavenger roll are great enough to cause adequate removal of fibers from the doffer without engagement between the scavenger bristles 32 and the doffer clothing. Therefore, the bristles 32 need not actually touch or extend into the bristles of the clothing 25. Excellent results are obtained where the bristles 32 extend just short of touching the clothing bristles. This greatly increases the life of the clothing 25 and the scavenger bristles 32. By this method at least part of the fibers not taken by nonselected needles 12 but also at least part of the residual fibers left by selected needles on the doffer are removed by the scavenger roll 30. For example, where the needles 12 leave a residual of about 30 percent of the fibers on the doffer, the scavenger will remove down to about 15 percent residual fibers. This assures uniform scavenging over the entire perimeter of the doffer. Of course, where it is essential that the doffer be as nearly as possible completely cleaned of fibers, the bristles 32 may be caused to barely enter the doffer clothing 25 to a sufficient extent to accomplish this purpose. The desired adjustment of the doffer for either centrifugal/air scavenging or contact-centrifugal scavenging may be effected through the bracket 35 provided for this purpose with elongated slots **37*a* for the screws 37**.

Scavenged fibers centrifuged from the scavenger roll 30 are, according to one embodiment of the invention (FIGS. 4 and 6), collected, and then dispersed, and returned for recycling by the carding roll 22 from which the fibers were originally transferred via the intermediate roll 23 to the doffer 24 from which excess fibers were scavenged. For this purpose, a collecting hood 41 encloses the scavenger roll 30 with an opening **41*a* directed generally toward the doffer 24. Air drawn through the opening 41*a* into the hood 41 and past the scavenger roll 30 will entrain and carry the fibers released by and from the scavenger roll 30, through a stack 42 leading from the hood 41 to a suitable recycling fan 43 which may be of the blower wheel type driven by an electrical motor 44 or other means which draws the air and fibers through the duct 42 into the center of the fan from which the air and fibers are dispersed and driven from the perimeter of the fan into a return duct 45 communicating with a recycle hood 47 constructed and arranged, as shown in FIG. 4, to return the stripped fibers to the perimeter of the carding wheel 22** for reuse.

In order to assure as uniform and dispersed distribution of the returned fibers as possible on the perimeter of the main or card wheel 22, and more particularly the section of the clothing 25 thereof from which those fibers were originally derived, the hood is dimensioned to provide a return mouth 48 complementary to as large a circumferential area of the wheel 22 as practical between the point at which sliver is fed to the wheel 22 and the point at which fiber is transferred to the intermediate roll 23 from the wheel 22. Further, the width of the hood 47 and more particularly the mouth 48 (FIG. 6) is such as to attain efficient return of the fibers to the card wheel clothing 25 without loss of fiber. To this end, all edges of the hood 47 defining the mouth 48 are placed as close as possible to the tips of the card wires of the clothing 25 while still remaining out of contact with the wires, and the width of the hood is slightly less than the width of the clothing 25, with laterally extending lip flanges 49 extending toward the margins of the clothing 25. Thereby, air pumped by the fan 43 and carrying the fibers through the hood 47 to the wheel 22 can escape through the layer of fibers thus deposited on the card wires and through the card wires. Fibers pneumatically applied to the wheel 22 are carried to and supplement the sliver fibers supplied to the wheel. To enhance escape of the air, the drum of the wheel 22 may be provided with radial air holes 50.

In order to effect through dispersion of the returned fibers for uniform application to the perimeter of the roll 22, dispersion means are provided in the hood 47 comprising a set of dispersion vanes 51. These vanes 51 as mounted in the hood 47, project thereinto from respectively opposite side walls of the hood in staggered spaced relation, approaching closely to but spaced from the opposite side wall in each instance and each having a sloping upstream edge 52 extending from the upstream end of the attached edge of the vane in downstream direction to a smoothly curved juncture with the unattached side edge, substantially as shown, whereby to avoid any hangup of fibers on the upstream edges of the vanes. Alternate ones of the vanes 51 may be of different length as, for example, the vanes 51 extending from one of the side walls of the hood 47 may be longer than the vanes extending from the opposite side wall, but with the downstream ends of the vanes close to the mouth 48. In addition, improved results are attained by having the spacing between the vanes progressively wider from their upstream ends to their downstream ends, generally proportionate to the progressively increasing spread of the hood from its inlet end to the mouth 48. Through this arrangement, excellent dispersion of the recycled fibers is attained for reasonably uniform return to the perimeter of the card roll 22.

In addition to the fibers scavenged by the roll 30, loose fibers blown from the needles 12 by the air jet nozzles 17 are recovered and returned to the card roll 22 from which they were originally derived. To this end, the hood 41 is dimensioned to have its entrance opening large enough to receive the fibers blown from the needles, the lower end of the hood 41 being extended downwardly for this purpose as shown in FIG. 4. Thereby the suction created by the fan 43 will draw the loose fibers which have been blown from the needles on up into the stack duct 42 together with the scavenged fibers from the scavenger roll 30.

In order to avoid secondary air streams or other interference from the rotating scavenger roll 30 with movement up within the hood 41 of the fibers dislodged from the needles 12, a shield 53 is mounted across the inside of the hood 41 about the return perimeter portion of the scavenger roll 30, for about 180°. At its lower end, the shield 53 stops short of the doffer 24 and the shield 53 provides with the lower end of the hood 41 a funnel-like receiving throat for the fibers blown from the needles 12. Thence, the fibers are sucked up through the arcuate passage provided between the shield 53 and the adjacent wall of the hood 41 and past an upstanding shield extension portion 54 of the shield to comingle with the fibers scavenged by the roll 30 moving upwardly in the hood 41 into the stack duct 42. Thereby not only are the roll-scavenged fibers but also the fibers blown loose from the needles recovered and recycled for eventual use in the same recycling system.

If preferred, instead of returning the fibers for recycling directly to the card wheel 22, the fibers may be returned to the sliver as shown in FIG. 7. For this purpose the return duct 45' leading from the recycling fan delivers to a hood 47' discharging the fiber therefrom onto the sliver 18 or 19, as the case may be, from which originally derived so that the recycled fibers will be fed to the carding roll 22 with the sliver. The sliver approaches the card wheel 22 on a length of screen 55 which to assist in moving the sliver is in the form of an endless flexible belt which may comprise screen wire or a perforated web running toward the card wheel 22 over a pulley 57 adjacent to the card wheel and returning therefrom and over a return pulley 58 spaced a suitable distance from the card wheel 22 and with the pulleys supported by the frame 10 to have the carrying run of the screen 55 uphill toward the card wheel. A path for the sliver to the wheel 22 is provided by a guide 59 which leads upwardly tangentially to the screen 55 where it returns over the roller 58, and between guiding side plates 60 along the sides of the endless screen 55.

Conveniently, the delivery hood 47' is dimensioned to fit between the guide plates 60 to discharge onto the sliver transported by the endless belt screen 55, with the air transporting the loose, returned fibers passing on through the sliver as a filter and escaping through the screen 55. To facilitate full recovery of the airborne returned fibers, the lower or rear edge of the hood 47' has a deflector flange 61 angled toward the sliver on the screen 55 in the direction of movement of the sliver with the screen. At the front edge of the hood 47' a corresponding forwardly oriented deflector flange 62 assures that fiber laden air will not escape forwardly from the hood but will be deflected onto and through the screen carried sliver, while extending the area of fiber return coverage over the surface of the sliver. A rearwardly extending guide flange 63 may be provided from the rear edge of the hood 47' in overlying relation to the area of transition of the sliver from the guide 59 to the guide 60 and the screen conveyor belt 55. Dispersion of the air borne fibers in the hood 47' is adapted to be effected by means of dispersion vanes 51' similar to the vanes 51 in FIGS. 4 and 6.

Referring to FIG. 8, a modified scavenging system is shown which is adapted to be used with a fiber feed path provided with two independent alternately selectively operable fiber or sliver supplies. In addition to the one pair of sliver feed rolls 20 associated with the carding roll 22 at the selected feed path, a second pair of sliver feed rolls 20' is associated with the carding roll at the same path, and the rolls 20 and 20' are independently controlled, for example, as taught in Brandt U.S. Pat. No. 3,122,904, to feed sliver of different character such as color, selectively and alternately to the carding roll. This creates the problem of maintaining sharp separation between the contacting interfaces of pattern figures such as stripes or other figures on the deep pile knitted fabric when switching from one character of sliver to another character of sliver in the fiber feed path. The problem is readily solved by the arrangement depicted in FIG. 8 which discloses the apparatus in much the same manner as in FIG. 4, and common reference numerals are to be understood as relating to elements already described in relation to FIG. 4. Although the scavenger roll 30' may be mounted on a fixed axis as in FIG. 4, it may be carried by one end portion of a lever bracket **30*a* intermediately pivoted at 30*b* and coupled at its opposite end to an actuator 30*c* mounted on a support 30*d*. By operation of the actuator 30*c* the roll 30' can be adjusted to vary its scavenging action. However mounted, the roll 30' functions to scavenge fiber from the doffer 24 and return the fibers via the duct 45'' and the hood 47'' to the clothing 25 of the carding roll 22 for recycling while any selected one of the sets of sliver rolls 20 or 20' feeds sliver into the fiber feed path. When a switch in the sliver supply is made all of the scavenged and returned fiber of the previous supply is removed, with any residual fibers remaining on the carding roll clothing 25, by a stripper or scavenger roll 70 mounted within a hood 71 having its mouth 72 closely aligned with a segment of the perimeter of the roll 22 at the off-running side of the hood 47''. Within the hood 71 the roll 70 is mounted in a hooded bracket 73 mounted on a pivot 74 so that the bracket can be rocked by means of an actuator 75 to move bristles 77 of the roll 70 into or out of fiber stripping contact with the clothing 25 of the roll 22.**

Operation of the actuator 75, which may be an air cylinder or other type of actuator, is such as to move the roll 70 into operative position relative to the roll 22 for brief intervals at the time the sliver feed clutches associated with the feed rolls 20 and 20' are selectively operated to change fiber characteristics. For a brief interval after switching the clutches, fibers of mixed character may be contained in the carding path and the roll 70 operating at high speed removes the mixed fibers very rapidly and discharges them through the hood 71 and a duct 78 for discharge as waste into a fiber-collecting receptacle remote from the knitting machine. During this change over, the adjustably mounted roll 30' is adapted to be moved in coordination with the roll 70 closer to or into the doffer 24 to increase the intensity of scavenging action of the roll 30' to clean the doffer 24 more thoroughly. As a result, horizontal stripes and plaids can be manufactured having much sharper and cleaner interfaces between adjacent pattern figure areas and more uniform density between adjacent figure areas is attained. Means for controlling operation of the actuators 75 and 30c in coordination may comprise the electropneumatic system shown diagrammatically in FIG. 9. A solenoid actuated four way valve 79 in control of the actuators 75 and 30c is controlled by a time delay relay 80 associated with the feed rolls 20 or a time delay relay 21 associated with the feed rolls 20'. Closing of a switch 82 in a circuit with the time delay relay 80 causes a normally open relay switch 83 to close and thus operate the solenoid valve 70 to operate the actuators 75 and 30c to move the rolls 70 and 30' into operating position relative to the rolls 22 and 24. At the end of a present time interval the switch 83 will open, deenergize the solenoid valve circuit, providing the alternate relay 81 has not been activated in the meantime. A spring 84 returns the valve 79 to the normal position wherein the actuator 75 inactivates the roll 70 with respect to the roll 22 and the actuator 30c returns the roll 30' to normal scavenging position. In the same manner, the actuators 75 and 30c may be operated by energizing of the time delay relay 81 through a switch 85 associated with the feed rolls 20' and adapted to close a circuit through the time delay relay 81 for closing a switch 87 under the control of this relay. Coordinated operation of the actuators 75 and 30c may be simultaneous as shown, but may be sequential, if preferred.

Whether the scavenged and recycled fibers are returned to the carding roll 22 or to the sliver, improved control can be attained by monitoring the fiber density in the fiber delivery path. Such monitoring may be effected on the perimeter of the carding roll 22 (FIGS. 4 and 8) or on the sliver supply belt 55 (FIG. 7). Monitoring may be effected with any suitable type of sensor, for example, piezoelectric, beta ray, electrical capacitance or pneumatic. In FIGS. 7 and 10 a pneumatic sensor 90 is depicted. Low pressure air is introduced by way of a conduit 91 through an orifice 92 providing a pressure drop and preventing cross-talk between signals from sensors on other carding heads supplied by a common air source. Air thus supplied enters into a passage 93 which connects at one end with a monitoring opening 94 through the flange 62 which engages the surface of the sliver. Where the flange 62 is not available a foot plate may be provided to serve the same function. Air supplied to the passage 93 escapes through the opening 94 and passes through the sliver. As the sliver density increases, the rate at which air is leaked decreases and, conversely, as the sliver density decreases, the rate at which air passes therethrough increases.

As the rate at which air issuing through the opening 94 passes through the sliver changes, the pressure drops at the sliver and at the air delivery orifice 92 both change, resulting in pressure changes in a lower chamber 95 within a transducer casing 97 and with which the opposite end of the passage 93 communicates through an orifice 98. The orifice 98 avoids rapid changes of pressure in the chamber 95 and serves to filter out variations that might be caused by small voids, wrinkles, or other short-term variations in the sliver. Air pressure within the chamber 95 exerts a force against a flexible diaphragm 99 which is coupled with a load cell 100 within a second chamber 101 in the casing 97 and which is vented to atmosphere through an opening 102. Changes in force exerted by the diaphragm 99 on the load cell 100 effect corresponding changes in an electrical circuit effecting signals which are amplified through an amplifier 103 and transmitted to a D.C. motor controller 104 to drive a D.C. motor 105 at a compensating speed. For transmitting power from the motor 105 it is coupled through a gear 107 with transmission means such as a differential gear mechanism contained within a housing 108 and which differential gear mechanism is also coupled through a shaft 109 with the mechanical drive from the carding head running at a constant speed. Coupling of the transmission gear mechanism with the sliver feed belt roller 57 and a companion feed roller 110 is effected by means of a gear train 111 coupled with the differential gear mechanism through a drive shaft 112. In the gear train 111 may be included connect disconnect means such as an air clutch 113. When sliver passing the sensor 90 is detected as minimum density, signals supplied by the sensor will be minimum, causing the motor 105 to run at creeping speed or even stopped. Under such condition the driving rotation of the input shaft 112 will be equal but opposite to rotation of the input shaft 109. When density of the sliver increases, the sensor signal to the motor 105 causes the motor to increase speed which results in a compensating effect causing the output shaft 112 to slow down and thereby causing the denser sliver to be fed more slowly. An advantage of the gear train 111 is that by suitable gear changes the base speed of mechanical drive can be adjusted to suit the physical characteristics, such as fiber size, of the sliver being supplied, and to suit the weight of fabric desired in the knitted pile fabric end product. The clutch 113 is desirable to enable sliver feed to be stopped and started in a programmed manner as taught, by way of example, in Brandt U.S. Pat. Nos. 3,122,904 and 3,709,002, according to which fiber feed can be started and stopped when encountering large pattern features. The present scavenger system, however, is effective for attaining uniformity of density effects in small pattern features which require response rates not achievable, and buffer pattern geometry physically incapable of attainment with, the teachings in the Brandt patents.

On reference to FIG. 11, a modified sliver feed control responsive to sliver density is depicted utilizing sensors 90' which correspond to and operate the same as the sensor 90, and common reference numerals relate to common features. In this instance the openings 94 of the sensors are associated with respective foot plates 114 which engage the surface of the sliver. Two sensors 90' are depicted in a system wherein the air supply conduits 91 are connected with a common air supply duct 115 leading from the pressure air source.

According to the control system of FIG. 11, means comprising a single potentiometer 117 is connected in the electrical circuit with the load cell 103' and the motor controller 104' in respect to each of the motors 105'. By adjusting the potentiometer 117 the base speed can be individually set for each of the sliver feed lines to feed the correct amount of base sliver to achieve the desired unit weight of fabric. The sensor signal from the load cell amplifier 103' in each instance is subtracted from the base speed signal to control the motor 105' at a compensating slower speed when abnormally dense sliver is detected by the sensor 90'. In this instance the motors 105' are directly coupled with the rolls 57 and 110 through gears 118. Starting and stopping of the motor 105' independently of the sensor control circuit is effected by means of respective control switches 119, which may, if desired be relay contacts controlled from a preprogrammed indicia on a tape or from indicia stored in a computer memory in a manner, for example, in which clutches are controlled in Brandt U.S. Pat. No. 3,709,002. In this instance air clutches and differential gearing are eliminated. The motors 105' may be provided, as is conventional, with brake means to minimize overtravel.

Although, in FIGS. 10 and 11, D.C. motors are indicated, any other type of variable speed motor may be used such as A.C. motors wherein the speed is varied by varying the A.C. frequency in well known manner.

From the foregoing it will be apparent that the present invention provides for the efficient control of fiber density in patterned deep pile circular fabric knitting, avoiding the need in many fabrics for density control to be programmed into a pattern and in all cases reducing the critical nature of such programming. Complete assurance of uniform density is provided because at all times a uniform layer of fibers on the doffer is presented to the knitting needles. Even though the doffer is continuously scavenged in each rotation, the removed fiber need not be wasted but may be fully salvaged together with loose fibers blown from the knitting needles, by being recycled in the path in which it originated. That is, the fiber is returned and redeposited in dispersed manner at the card wheel or at the sliver, and there is no mixing of fibers from one path with the fibers in another path. When the fiber is redeposited at the sliver it is dispersed to the extent that the fiber scavenged during one revolution of the doffer will be returned thereto at a rate that will disperse it over about 100 revolutions of the doffer. Neither is any one path overloaded since it receives for recycling only fibers which originated in that path. Uniformity of results are therefore assured in every line at every carding and feeding unit in the machine.

It will be understood that variations and modifications may be effected without departing from the spirit and scope of the novel concepts of this invention.

I claim as my invention:

1. In apparatus for manufacturing patterned deep pile circular knitted fabric, including means defining a fiber feed path in which fibers are transferred to the clothing of a doffer rotating in one direction, and knitting needles carried by a rotary cylinder, said needles being adapted to selectively take part of said transferred fibers from the doffer clothing but allowing some of the fibers to remain on the doffer clothing, the improvement comprising:

a scavenger roll for continuously scavenging from the doffer clothing fibers remaining nonuniformly on the doffer clothing in the area thereof between where the knitting needles may take fibers from the doffer and where the fibers are transferred to the doffer;

means defining a pneumatic passage leading away from said scavenger roll and having hood means partially enclosing the scavenger roll and having an air inlet opening adjacent to the doffer;

means in said passage for effecting movement of air inwardly through said opening and along said passage to carry away the scavenged fibers;

means for discharging the scavenged fibers from said passage and delivering the discharged fibers to a location along said fiber feed path for retransfer to the doffer;

mechanical dispersing means located in said passage whereby to assure uniform delivery of the scavenged fibers to said location;

said means defining a fiber feed path including a carding roll; and said discharging and delivering means comprising a hood having means defining a discharge opening complementary to a substantial peripheral area of the carding roll and directed to discharge the scavenged fibers onto the periphery of the carding roll.

2. Apparatus according to claim 1, wherein said scavenger roll generates fiber dislodging air current impinging the doffer clothing to assist the mechanical device in removing fibers from the doffer clothing and to facilitate pneumatic conducting of the fibers away from the vicinity of the doffer through said passage.

3. Apparatus according to claim 1, wherein said passage comprises in part a stack in which the fibers scavenged from the doffer and loose fibers from the vicinity of the knitting needles and sucked in through said hood means are commingled, a return duct leading from said stack to said discharging and delivering hood, said air movement effecting means comprising a blower fan driving the commingled fibers from the stack through said duct, and means for mechanically dispersing the fibers in said duct adjacent to said discharge opening.

4. Apparatus according to claim 3, wherein said dispersing means comprise a set of dispersing vanes mounted in said discharging and delivery hood.

5. In apparatus for manufacturing patterned deep pile circular knitted fabric, including means defining a fiber feed path in which fibers are transferred to the clothing of a doffer rotating in one direction, and knitting needles carried by a rotary cylinder, said needles being adapted to selectively take part of said transferred fibers from the doffer clothing but allowing some of the fibers to remain on the doffer clothing, the improvement comprising:

a scavenger roll for continuously scavenging from the doffer clothing fibers remaining nonuniformly on the doffer clothing in the area thereof between where the knitting needles may take fibers from the doffer and where the fibers are transferred to the doffer;

means in said fiber feed path for alternately selecting fibers of different characteristics for feeding to said doffer;

means selectively operable for purging unwanted fibers of one selected characteristic from the fiber feed path when fibers of different selected characteristic are to be fed to the doffer; and means for adjusting the spacing between the scavenger roll and the doffer to scavenge less than all fibers from the doffer during normal operation of the apparatus and to adjust the spacing between the scavenger roll and the doffer to strip the doffer substantially clean when the purging means is in operation.

6. Apparatus according to claim 5, wherein said means defining a fiber feed path comprise a carding roll, said purging means comprising a purging roll, and means for adjusting the purging roll relative to the carding roll and said means for adjusting the scavenger roll relative to the doffer comprising integrated circuit means operative to move said rolls in coordinated relation.

7. In a method of manufacturing patterned deep pile knitted fabric in a machine having a plurality of fiber feeding units providing separated fiber feeding paths each of which terminates in a doffer to which fibers are transferred differing in some characteristic from the fibers in the other paths, and knitting needles adapted to selectively take part of the transferred fibers but allowing some of the fibers to remain on the doffers so that there is nonuniform depth of accumulation of fibers on the doffer clothing which would act to produce nonuniform density in the patterned knitted fabric, the steps of:

scavenging from each of the respective doffers at least the fibers remaining non-uniformly on the doffers after the needles have taken the fibers and leaving the doffer surfaces in condition for uniform transfer of fibers thereto from the respective fiber feeding paths before the knitting needles again take fibers from the doffers;

maintaining the fibers scavenged from each of the doffers isolated and substantially free from commingling with the fibers scavenged from the other doffers;

pneumatically returning the isolated scavenged fibers and loose fibers from the vicinity of the knitting needles to the same fiber feeding unit from which they were originally transferred to the respective doffer;

during such returning of the fibers dispersing the fibers for uniformly distributing the returned fibers on freshly supplied fibers in the respective fiber feeding unit path for retransfer of the returned fibers to the respective doffer together with the freshly supplied fibers;

whereby not only to collect scavenged and loose fibers but also to eliminate density variations in the patterned deep pile circular knitted fabric produced by the apparatus.

8. A method according to claim 7, including monitoring the density of fibers in each of the respective fiber feeding paths of the fiber feeding units after the pneumatically returning of the fibers thereto, and in accordance with the fiber density monitored in each such path controlling the supplying of fibers to the path to maintain uniform fiber transfer to the respective doffers.

9. A method according to claim 7, comprising effecting return of the fibers to the freshly supplied fibers in the respective fiber feeding unit paths through a confining hood, employing the freshly supplied fibers in the feeding paths as filter means, and thereby removing the air accompanying returned fibers.

10. A method according to claim 7, comprising distributing the returned fibers onto freshly supplied fibers on the periphery of a carding roll in the feeding path of the respective fiber feeding unit.

11. A method according to claim 7, comprising distributing the returned fibers onto freshly supplied fibers carried on a fiber delivery conveyor in the feeding path.

12. A method according to claim 7, comprising effecting said scavenging by rotatably driving a scavenger roll in scavenging relation to the doffer in the area of the doffer between where the knitting needles may take fibers from the doffer and where fibers are transferred to the doffer, effecting suction through a hood which substantially encloses the scavenger roll and has an air inlet opening adjacent to the doffer and the knitting needles, and thereby pneumatically drawing scavenged fibers and loose fibers from the vicinity of the knitting needles into a passage in which returning of the fibers is effected.

13. A method according to claim 12, comprising moving air through the passage from said hood to the point of return in the feeding unit by operating a blower fan in said passage, and mechanically dispersing the fibers in the passage downstream from the blower fan.

14. A method according to claim 13, comprising effecting said mechanical dispersing in a hood at the end of the passage through which the fibers are returned to the fiber feeding unit.

15. A method according to claim 7, comprising driving a scavenger roll relative to a doffer to effect the scavenging, and in driving of the roll developing centrifugal force to assist bristles of the roll in fiber removal from the doffer and causing discharge of fibers from the bristles of the roll.

16. A method according to claim 7, comprising effecting said scavenging by running a separate scavenger roll with bristles close to but short of touching the clothing of each of the doffers, and driving the scavenger rolls at a velocity sufficient to cause the bristles to create an air stream, whereby the combined effect of centrifugal force and air stream will effect not only removal of at least part of the fibers not taken by knitting needles from the doffers, but will also remove residual fibers left by selected needles on the doffer.

17. A method according to claim 7, comprising effecting said scavenging by driving a separate scavenging roll for each of the doffers in scavenging relation to the doffer and at a speed at which the scavenger roll generates fiber-dislodging air current impinging the doffer clothing to assist the roll in removing fibers from the doffer clothing.

* * * * *